US010937641B2

(12) United States Patent
Parchen et al.

(10) Patent No.: US 10,937,641 B2
(45) Date of Patent: Mar. 2, 2021

(54) MALDI MASS SPECTROMETRY METHOD

(71) Applicant: BiosparQ B.V., Leiden (NL)

(72) Inventors: René Raymond Parchen, Leiden (NL); Gerold Cornelis De Valk, Leiden (NL)

(73) Assignee: BiosparQ B.V., Leiden (NL)

( * ) Notice: Subject to any disclaimer, the term of this patent is extended or adjusted under 35 U.S.C. 154(b) by 0 days.

(21) Appl. No.: 16/614,078

(22) PCT Filed: May 18, 2018

(86) PCT No.: PCT/EP2018/063203

§ 371 (c)(1),
(2) Date: Nov. 15, 2019

(87) PCT Pub. No.: WO2018/211112

PCT Pub. Date: Nov. 22, 2018

(65) Prior Publication Data

US 2020/0176239 A1 Jun. 4, 2020

(30) Foreign Application Priority Data

May 18, 2017 (NL) ..... 2018940

(51) Int. Cl.
*H01J 49/16* (2006.01)
*H01J 49/04* (2006.01)

(52) U.S. Cl.
CPC ..... *H01J 49/164* (2013.01); *H01J 49/0418* (2013.01); *H01J 49/0445* (2013.01)

(58) Field of Classification Search
CPC ... H01J 49/164; H01J 49/0418; H01J 49/0445
See application file for complete search history.

(56) References Cited

U.S. PATENT DOCUMENTS

2005/0073683 A1 4/2005 Gard et al.
2009/0250606 A1 10/2009 Fergenson et al.

FOREIGN PATENT DOCUMENTS

EP 2210110 A1 7/2010
WO WO2010021548 A1 2/2010
WO WO2017035229 A1 3/2017

OTHER PUBLICATIONS

Russell et al., Aerosol matrix-assisted laser desorption/ionization mass spectrometry, Journal of Mass Spectrometry, 1996, vol. 31, No. 3, p. 295-302.

(Continued)

*Primary Examiner* — Nicole M Ippolito
*Assistant Examiner* — Hanway Chang
(74) *Attorney, Agent, or Firm* — Bret E. Field; Bozicevic, Field & Francis LLP

(57) ABSTRACT

The MALDI mass spectrometry method comprises the provision of a test composition comprising an analyte, a matrix material, a solvent for the matrix material and an antisolvent, which facilitates crystallization of the matrix material on the analyte subsequent to droplet generation. Due to the crystallization, a non-spherical particle morphology of the test sample is obtained. The test sample with a non-spherical particle morphology can be distinguished from test samples with an at least substantially spherical particle morphology by sensing a morphology parameter. Based on the sensing result, test samples with a non-spherical particle morphology are selected for ionization and mass spectrometry. The antisolvent is for instance water, and the solvent is an organic solvent. The formed crystals are in one embodiment crystallized in a hydrate form. As a result, a signature-rich spectrum is obtained.

20 Claims, 5 Drawing Sheets

(56) References Cited

OTHER PUBLICATIONS

Domin et al., The effect of solvent and matrix combinations on the analysis of bacteria by matrix-assisted laser desorption/ionisation time-of-flight mass spectrometry, Rapid Communications in Mass Spectrometry, 1999, vol. 13, No. 4, p. 222-226.
Hinz et al., Instrumentation, data evaluation and quantification in on-line aerosol mass spectrometry, Journal of Mass Spectrometry, 2007, vol. 42, No. 7, p. 843-860.
Zhou et al., Component and morphology biases on quantifying the composition of nanoparticles using single-particle mass spectrometry, International Journal of Mass Spectrometry, 2006, vol. 258, No. 1-3, p. 104-112.

MALDI MASS SPECTROMETRY METHOD

FIELD OF THE INVENTION

The invention relates to a MALDI mass spectrometry method for analysing an analyte, comprising the steps of

- Providing a test composition comprising an analyte, a matrix material a solvent for the matrix material;
- Generating droplets from the test composition, said droplets being ejected into a flow path with a length sufficient to achieve evaporation of the solvent and precipitation of the matrix material on the analyte, therewith obtaining a test sample;
- Verifying that each test sample contains a predefined number of analytes;
- Ionizing the test samples to obtain ionized components,
- Detecting the ionized components by means of a time-of-flight mass spectrometer and
- Identifying the analyte on the basis of the detected ionized components.

The invention further relates to a MALDI mass spectrometer apparatus with which said method can be performed.

The invention also relates to the use of matrix materials in performing a MALDI mass spectrometry method.

BACKGROUND OF THE INVENTION

MALDI mass spectrometry is a powerful analysis method for detection of analytes and more particularly analytes of biological origin, such as proteins, cells, microorganisms such as bacteria and the like. MALDI is herein an abbreviation for Matrix Assisted Laser Desorption Ionization. It indicates that the analyte is combined with a matrix material. Downstream of the combination of analyte and matrix material, use is made of a laser for ionization of the sample. The ionized components are detected by means of mass spectrometry.

Conventionally, MALDI samples are provided on a MALDI plate. The laser chooses a spot on the MALDI plate for ionization. However, a significant amount of analyte is provided on the MALDI plate, which hampers the detection. It could easily be that more than one type of cell is present on the MALDI plate. An alternative implementation of MALDI mass spectrometry starts with aerosols. The aerosols can be aerosols present in a gas stream, such as disclosed in EP1342256B1 and in EP2210110B1. Alternatively, aerosols may be generated by means of nebulization from a liquid composition.

An example of the latter aerosol method is known from D. H. Russell et al, *Journal of Mass Spectrometry*, vol 31 (1996), page 295-302. The tested proteins are bovine insulin, bradykinin acetate salt and horse heart myoglobin. These proteins were dissolved into the solvent with the matrix material. The solvent was an alcohol with up to 30% water added. The matrices were 4-nitroaniline and α-cyano-4-hydroxy cinnamic acid (HCCA), which is well known as MALDI matrix material. Nebulization was achieved against vacuum to produce liquid droplets that are cooled due to evaporation and form dense liquid or even ice particles. The particles are then warmed up by collisions with a gas in the heated drying tube, where the particles continue to decrease in size and break up. Co-crystallisation of the matrix and the protein analyte occurs. However, this method does not use a single analyte per measurement. More particularly, the analyte is not cellular, but rather can be dissolved with the matrix material in the solvent.

Rather than providing an aerosol, it would be more elegant to provide a stream of droplets. Then, it may be verified optically that each droplet contains a predefined number of cellular analytes. A preferred number is one, although another limited number, for instance up to 10 cellular analytes, suitably 1-5, such as 2 or 3, is also feasible. By limiting the number of analytes per sample, it becomes more easily to identify an analyte; i.e. there will not be any ambiguity as from which analyte within the sample any portion of the resulting spectrum originates. This method will be referred to as 'single particle MALDI', for sake of simplicity, without any desire to exclude the options that more than one cell is present per sample.

WO2010/021548 discloses the preparation of a test composition thereto. First a given sample is diluted with a solvent or water to obtain a predefined density. Thereafter, matrix material is added in a desired concentration to obtain the test composition. Subsequently, a stream (or beam) of droplets is generated out of the test composition by means of an piezoelectric resonator, such as an inkjet printing device. Here again, a particle detection may be carried out, so as to identify that there is one micro-organism in a droplet. In the method disclosed in WO2010/021548, the particle detection is carried out by fluorescence, and preferably before the addition of the matrix material, so as to prevent that matrix crystallisation obstructs detection of fluorescence from the micro-organisms.

In experiments with the MALDI mass spectrometry method, it was found that many of the resulting spectra did not contain a sufficiently strong signature to identify the analyte. Typically, in MALDI, such as in single-particle MALDI, a plurality of mass spectra from individual test samples is summed up to achieve a better signal-to-noise ratio, and to identify a signature of a micro-organism. A result is called signature-rich or signature-poor dependent on its signal-to-noise ratio. In relation to the negative, signature-poor results, it was verified that all micro-organisms were coated with a layer of MALDI matrix. It was further verified that all test samples contained a micro-organism.

SUMMARY OF THE INVENTION

It is therefore an object of the present invention to provide an improved MALDI mass spectrometry method for detection of an analyte such as a micro-organism, which is provided as a suspension, and wherein the detection method is signature-rich so as to enable identification. It is another object of the invention to provide a MALDI mass spectrometry apparatus therefore. It is a further object of the invention to provide the use of a test composition suitable for use in a MALDI mass spectrometry method and enabling the generation of signature-rich spectra.

According to a first aspect, the invention provides a MALDI mass spectrometry method, comprising the steps of:

- Providing a test composition comprising a cellular analyte, a matrix material, a solvent and an aqueous antisolvent for the matrix material, wherein said test composition is a suspension of the analyte wherein the solvent has a higher volatility than the antisolvent and wherein the antisolvent is present in excess quantity relative to the solvent;
- Generating a beam of droplets from the test composition, said droplets having a diameter in the range of 20-70 μm, preferably 30-60 μm, and being ejected into a flow path with a length sufficient to achieve evaporation of the solvent and the antisolvent and precipitation of the matrix material onto the cellular analytes, therewith obtaining a test samples, wherein the test composition and the droplet diameter effect a non-spherical particle morphology of the test sample;

Optionally, selecting test samples to be analysed on the basis of a morphology parameter representative of the particle morphology of the test sample;

Ionizing the optionally selected test samples to obtain ionized components,

Detecting the ionized components by means of a time-of-flight mass spectrometer, and Identifying the analyte on the basis of the detected ionized components.

According to a second aspect, the invention provides a MALDI mass spectrometry apparatus, comprising (1) a droplet generation device for generation of a beam of droplets and provided with a container for a test composition comprising a cellular analyte, solvent, antisolvent and matrix material; (2) a tubular chamber downstream of the droplet generation device and including a flow path of sufficient length to achieve evaporation of the solvent and antisolvent and precipitation of the matrix material on the analyte, therewith obtaining a test sample; (3) sensing means for measuring a parameter of test samples in the chamber; (4) a time-of-flight mass spectrometer; (5) ionization means for selectively ionizing test samples to be detected by the mass spectrometer, and (6) a processor for selection of test samples based on the sensed parameter and for identifying an analyte based on detected ionized components of the mass spectrometer. Herein, the sensing means are configured for measuring a morphology parameter representative of a particle morphology of the test samples, and the processor is configured for identifying a morphology of a test sample and to select the test samples for ionization based on the identified morphology.

According to a third aspect, the invention provides the use of a test composition for carrying out a MALDI mass spectrometry analysis on an analyte, said test composition comprising a matrix material and an organic solvent in which the matrix material dissolves, and an aqueous anti-solvent. The test composition is configured to be mixed with the cellular analyte and thereafter to be ejected as a beam of droplets with a droplet diameter of 20-70 μm, preferably 30-60 μm, so as to achieve crystallization of the matrix material onto the cellular analyte in a flow path, the cellular analyte with the crystallized matrix material having a substantially non-spherical shape, Thereto, the matrix material includes an aromatic ring, at least one functional group capable of hydrogen bonding and an C1-C8-alkyl chain, preferably C1-C4 alkyl chain. The matrix material has a solubility in the antisolvent of at most 2 mg/ml, preferably at most 1 mg/ml, more preferably at most 0.5 mg/ml. The solvent has a higher volatility than the antisolvent and the organic solvent and the aqueous antisolvent are present in a mass ratio in the range of 0.03 (1:33) to 0.33 (1:3), preferably 0.05 (1:20) to 0.25 (1:4).

The invention is based on the insight that signature rich spectra are generated, when the generation of the test sample involves crystallisation, and particularly the generation of plate-shaped or needle-shaped crystals. It was detected in investigations leading to the invention with prior art matrix materials, that the matrix material was precipitated on the cellular analyte in a predominantly amorphous form. While the test samples were formed as almost monodisperse particles, subsequent ionization and mass spectrometry, e.g. by means of ion mass separation, did not yield a signature-rich spectrum, but rather a spectrum substantially without any information. However, when modifying the test sample preparation to ensure the formation of crystals of matrix material onto the cellular analyte, the signature was significantly enhanced.

It has been found by the inventors in investigations leading to the invention, that not just the crystallisation is stimulated by addition of the antisolvent, but that the formed crystals moreover have a pronounced longitudinal shape. This more pronounced shape is deemed to result from a longer duration of crystallisation due to reaching a required level of supersaturation more quickly. Moreover, in view of the pronounced shape, due to using excess water, that the matrix material crystallizes in a different crystal form, more particularly in hydrate form. Particularly, plate-like crystals were formed wherein the crystals partly extended from the micro-organism (or other cell). In some cases, it appeared that the micro-organism (or other cell) was not covered in its entirety.

The formation of this crystal form with crystals extending from the surface of the micro-organism or other cell is even more surprising, as it occurred in the air. Since the droplet is free flying and very small, one would expect formation of substantially spherical test samples. This is indeed what happens in the prior art. However, in the invention, the shape substantially deviates from a spherical shape, and so much that the difference in shape of resulting particles may be used as a principle of detection.

This crystallization was achieved by the addition of an excess of an aqueous anti-solvent to the test composition and the formation of droplets with a predefined diameter. As a consequence, the matrix material will reach its saturation limit in the test composition soon after the ejection of a droplet into the flow path, particularly due to evaporation of the solvent. The organic solvent is more particularly chosen such that it is more volatile than the anti-solvent. In this manner, it is achieved that supersaturation of the liquid droplet with respect to the matrix material is achieved more quickly, resulting in a more pronounced crystallisation. The matrix material will then crystallize onto the cellular analyte. Suitably, the matrix material has a solubility in the aqueous antisolvent of at most 2 mg/ml, preferably at most 1 mg/ml, more preferably at most 0.5 mg/ml or even at most 0.3 mg/ml. The solubility is herein defined at room temperature as the intrinsic solubility. This is typically defined in silico. It is formally defined as the solubility in a state wherein a molecule is not dissociated. Preferably, the said solubility limit is furthermore met in experimental conditions at pH2 at 25° C. More preferably, the matrix material has a limited solubility in the antisolvent, for instance a solubility of at least 0.01 mg/ml, such as at least 0.05 mg/ml.

In accordance with the invention, the aqueous antisolvent is present in excess quantities, relative to the solvent. In experiments leading to the invention, mass ratios between the solvent and water in the range of 0.03 (1:33) to 0.33 (1:3) has been found suitable. The ratio is dependent on the matrix material, on the flow path available for evaporation and crystallisation and also on the temperature and other physical conditions at which the evaporation occurs. Preferably, the mass ratio is in the range of 0.05 (1:20) up to 0.2 (1:5), by further preference up to 0.125 (1:8), such as 1:9, for instance 10% water and 90% ethanol. While it is deemed practical to carry out evaporation and the preceding droplet generation at room temperature, it is not excluded to vary this temperature. A suitable temperature is for instance in a range of 15 to 50° C., preferably in the range of 20 to 40° C.

An additional advantage of using water as an antisolvent is that water may be incorporated into the crystal, to form a crystal in a hydrate form. The resulting crystal may be any suitable hydrate, for instance a monohydrate, a dihydrate, a trihydrate or even a form of a higher hydrate. The formation of needles and plates in the crystallisation of the matrix materials indicates the formation of hydrates. Such formation is clearly enabled in that the solvent evaporates first and that the excess of water increases over time, resulting in availability of water. The hydrates may be monohydrate, dihydrate, trihydrate, a semihydrate (0.5), tetrahydrate, pentahydrate or any other hydrate. It is not excluded that the plates and the needles constitute different hydrate crystals.

The aqueous antisolvent is in one embodiment pure water. In another and preferred embodiment, the antisolvent is acidified water, for instance to a pH in the range of 0-5, preferably 1-4. The aqueous antisolvent may be a salt solution that is compatible with mass spectrometry as known to the skilled person. Suitably, the salt concentration is at most 1 mM. Such salts contain more preferably compounds that may be decomposed and become volatile, so as to evaporate and prevent that the salts are incorporated into the crystal. As known to the skilled person, the incorporation of conventional salts, such as alkali salts into crystals, will render the MALDI mass spectrometry measurement useless.

In a preferred embodiment, the solvent is an organic solvent, such as an alcohol, an alkanone (ketone or aldehyde), an ether, a cyano-substituted alkane, an alkyl-acetate. The organic solvent is suitably based on an $C_1$-$C_5$ alkyl chain, more preferably $C_1$-$C_3$ alkyl. Preferably the polarity of the organic solvent is not too low, which enables appropriate solubility of the matrix material and dispersibility of the analyte. Furthermore, an adequate polarity enables that the solvent is miscible with the antisolvent. For instance, the solvent may have a polarity as expressed by means of a polarity index P' of at least 2.0, more preferably at least 3.0, or even at least 3.5 or at least 4.0. This polarity index P' is defined by L. R. Schnyder (see L. R. Snyder, "Classification of the Solvent Properties of Common Liquids", J. Chromatogr. Sci., 1978, 16, 223-234). More particularly, the solvent has a boiling point below 90° C. or preferably below 85° C. at atmospheric pressure. Most preferred examples of solvents include acetone, acetonitrile, ethanol, methanol, 2-methoxyethanol, n-propanol, isopropanol.

In a preferred embodiment, the matrix material includes an aromatic ring, at least one functional group capable of hydrogen bonding and a C1-C8-alkyl chain, preferably C1-C4 alkyl chain. This combination of structural features of the matrix material has been found to have a combination of desired properties. The aromatic ring, which may be heterocyclic ring, is relevant as part of a chromofore-functional group, as known in the art. Therewith, the laser light can be efficiently absorbed to achieve ionization. Additionally, the aromatic ring contributes with the alkyl chain to hydrophobicity, resulting in a low solubility in the aqueous antisolvent. The functional group capable of hydrogen bonding is for instance chosen from a thiol, an alcohol group, an acid group, an amine group. This enables hydrogen bonding with proteins in a cell wall of the cellular analyte.

In one embodiment, the matrix material is chosen from the group of

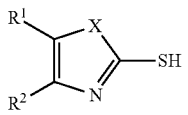

(I)

Herein X is N, S or O, and wherein $R^1$ and $R^2$ are independently chosen from hydrogen, methyl, ethyl, methoxy, ethoxy, propoxy and at least one of them is not hydrogen. Preferably, the matrix material is a thiazole- or an imidazole-compound. Good results have been obtained with thiazole-compounds. Examples include 5-ethyl-2-mercaptothiazole, 3,4-dimethyl-2-mercaptothiazole, 6-amino-2-mercaptothiazole, 6-ethoxy-2-mercaptothiazole. Preferred examples are 3,4-dimethyl-2-mercaptothiazole and 5-ethyl-mercaptothiazole. This class of materials is known per se for use in MALDI mass spectrometry, for instance from Xu et al, *J. Am. Soc. Mass Spectrom* 8(1997), 116-124. Xu et al deposit the test composition on a sample plate well, and subsequent drying. In that situation, typically, the crystallisation occurs at the interface between the test composition and the surface of the plate, resulting in homogeneous crystals.

In another embodiment, the matrix material is chosen from the group of C1-C8-alkyl esters of the group of optionally cyano-substituted hydroxyl-substituted cinnamic acid. Examples are the methyl-, ethyl-, propyl- and butyl-esters of α-cyano-4-hydroxy-cinnamic acid and of 2-cyano-4-hydroxyl-cinnamic acid and the esters of sinapinic acid. Esters of other conventional matrix materials such as 2,5-dihydrobenzoic acid are also feasible.

In a further embodiment, a crystallisation promoting additive is added into the test composition. Such an additive preferably comprises hydrophobic particles. Examples thereof are graphene flakes as commercially available. The hydrophobic particles suitably have a thickness in the nanometer range, for instance less than 100 nm or preferably less than 50 nm, or even less than 25 nm, and a diameter of up to several micrometers. It is deemed advantageous that the hydrophobic particles are added in a quantity so as to dose a single particle per droplet. It is believed by the inventors that the addition of a crystallisation promoting additive reduces the required degree of oversaturation (also known as supersaturation) for the onset of crystallisation. Herein, the added particles act as a crystallisation nucleus. Due to the thickness in the nanometer range, the equivalent aerodynamic diameter suitably at most in the order of several microns, for instance less than 3 μm. They do not disturb any further measurement of the morphology parameter.

The beam of droplets in the invention was generated by means of a droplet dispenser such as based on a piezoelectric resonator. The droplet dispenser had an exit tube, i.e. a nozzle, that specified the desired droplet diameter. Good results were obtained with droplets in the range of 20-70 μm, such as 30-60 μm. A droplet diameter in the range of 30-45 μm is even more preferred. Too large droplets include the risk of contamination that might affect the mass spectrometric measurement. The cellular analyte typically has a size in the order of 1-2 microns. With a droplet diameter of 100 μm, the effective ratio between the single cellular analyte and initial droplet is almost $10^6$. A contamination in the range of ppms can then have an impact on the measurement. When decreasing the droplet diameter, the ratio between initial droplet and final particle quickly reduces. For a droplet of about 30 μm, the ratio will be in the order of $3 \cdot 10^4$. The lower limit on the droplet size is defined by the amount of matrix material needed, since the concentration of the matrix material should not exceed saturation before ejection of the droplets.

In the context of the present invention, droplet diameters are measured optically using a stroboscopically addressed LED ("strobe LED"), with a frequency of 500 Hz and a duration of 5 μs. A digital camera, for instance based on a CCD-image sensor, was used for evaluation. Droplets were generated by means of a droplet dispenser having a piezoelectric resonator with a frequency of 500 Hz. This method is described in more detail in K. Thurow et al, *Journal of Automated Methods and Management in Chemistry*, vol 2009, article 198732, doi: 10.1155/2009/198732, which is included herein by reference.

Furthermore, it is observed that the claimed range of droplet diameters identifies feasible droplet diameters. Once that a droplet dispenser has been calibrated for a specific droplet diameter within that range, the droplet diameter will have an error of tolerance well within said range, for instance an error (standard deviation) of at most 5 microns, or even of at most 2 microns.

In one preferred embodiment, the selection step comprises evaluating whether the test particle has a non-spherical particle morphology or an at least substantially spherical particle morphology. It will be understood and is illustrated in the figures that the test particles with a spherical particle morphology need not to be perfectly spherical. Based on the evaluation, the apparatus will select test particles with a non-spherical particle morphology for ionization. This is particularly arranged by means of a controller. It is not excluded that only part of the test particles having a non-spherical particle morphology is ionized. As known in the art, the ionization is suitably carried out by means of a laser. As will be explained hereinafter, there are several embodiments for sensing of the morphology parameter. In addition to sensing the morphology parameter, the method may comprises the step of optically detecting the presence of an analyte in the droplet. Such optical detection could be carried out simultaneously with the sensing of the morphology parameter. Alternatively, it may be carried out upstream thereof, for instance upon generation of the droplets. Droplets without biological material may then be ejected into an alternative flow path towards a waste container.

It is moreover observed that spherical particles may still be formed, in addition to substantially non-spherical particles. This is due to non-uniformities in the mass ratio between solvent and water, and possibly also other processes beyond control, such as water absorption by the analyte. In view hereof, it is deemed suitable in accordance with one aspect of the invention, to perform a selection of the test samples, so as to ionize selectively those test samples that have a non-spherical shape. The selection comprises a sensing step to sense a morphology parameter representative of the particle morphology and to perform the selection based on the results thereof.

Preliminary investigations have shown that the non-spherical test samples differ from the spherical test samples with respect to the aerodynamic diameter and also with respect to the standard deviation of the aerodynamic diameter. Typically, the aerodynamic diameter of the spherical test samples is significantly larger, for instance at least 10%, more particularly at least 20%. In one implementation, the aerodynamic diameter of the non-spherical test samples (including crystalline material) was in the order of 1.0-2.0 μm, whereas spherical test samples (including amorphous material) was about 2.5 μm. The standard deviation of the aerodynamic diameter is even more distinct: for the spherical test samples, this deviation is small, in the sense that the relative orientation of the test sample relative to the optical detection means does not lead to much variation in the diameter. This renders the aerodynamic diameter of the spherical particles predictable, allowing the non-spherical particles to be distinguished therefrom. For the non-spherical test samples, this deviation is much larger, i.e. the aerodynamic diameter varies with the orientation to the optical detection means. In view of the difference in crystallinity, a further implementation of the morphology is a reflectivity of radiation of predefined wavelength(s); the crystals will generate a more pronounced reflectivity of incoming radiation.

BRIEF INTRODUCTION OF THE FIGURES

These and other aspects of the invention will be further elucidated with reference to the Figures, wherein.

Figure 4:
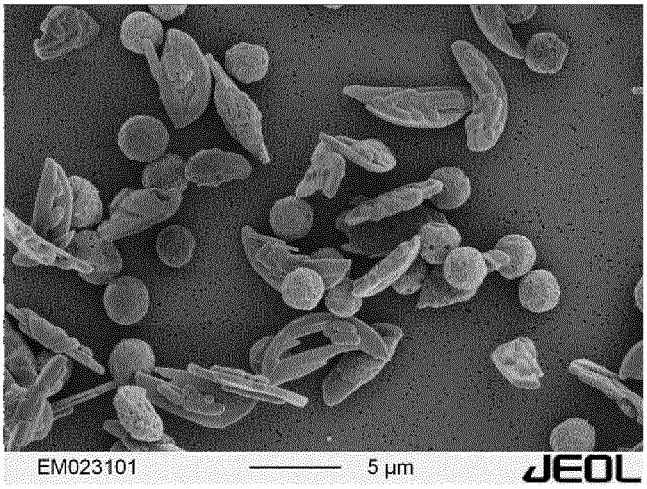
FIG. 4 shows a SEM-image of a plurality of test samples prepared in accordance with one embodiment of the invention.
Figure 6A:
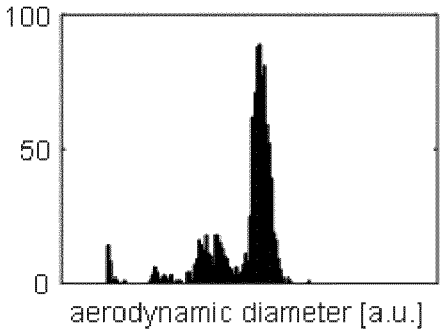
Figure 6B:
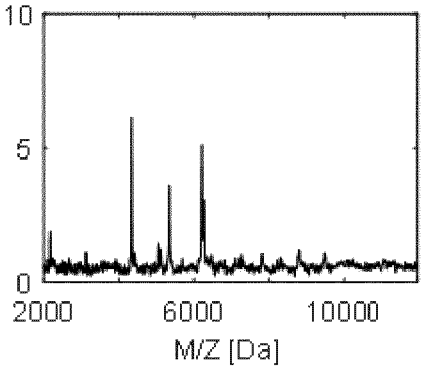

FIG. 6*a* shows a graph of the aerodynamic diameter profile for the plurality of test samples shown in FIG. 4;

FIG. 6*b* shows a mass spectrum of the plurality of test samples shown in FIG. 4

Figure 7A:
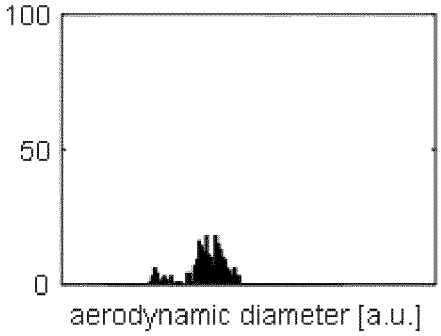
Figure 7B:
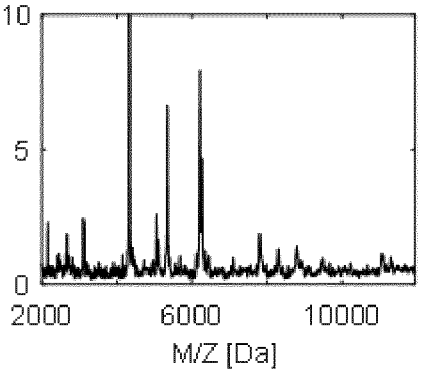
Figure 8A:
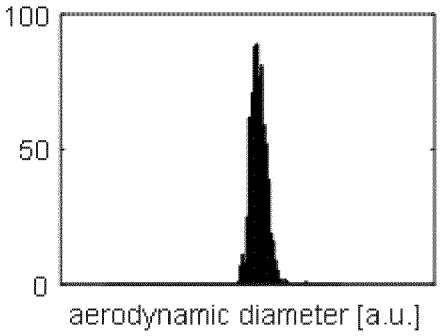
Figure 8B:
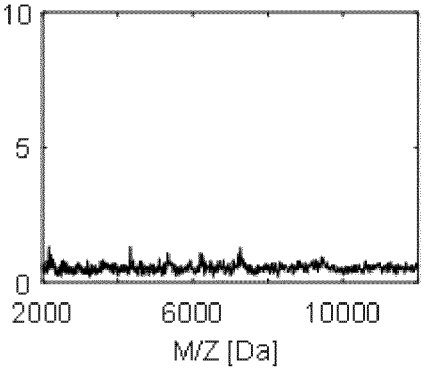
Figure 9:
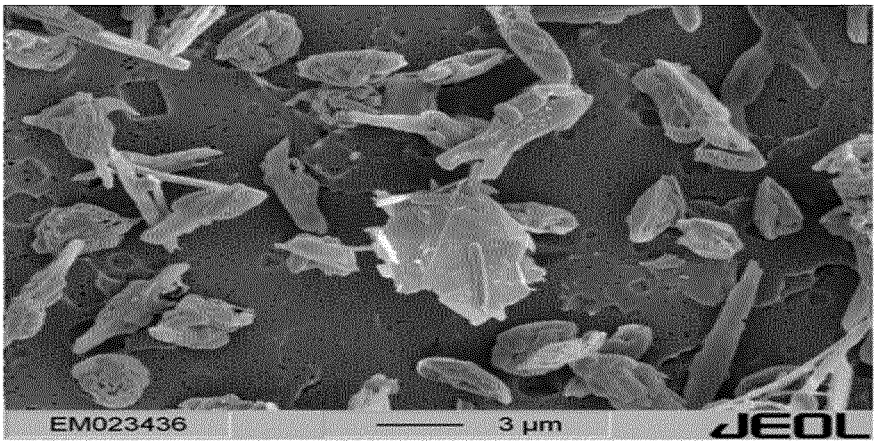
Figure 10A:
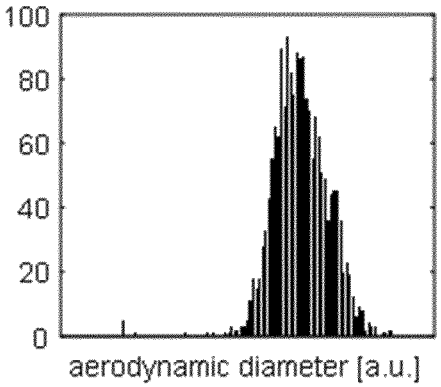
Figure 10B:
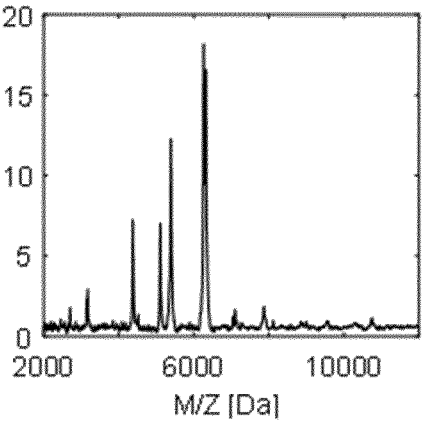
Figure 11:
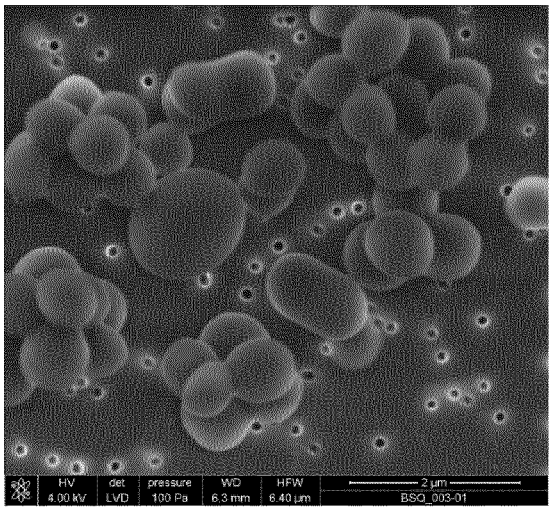
Figure 12:
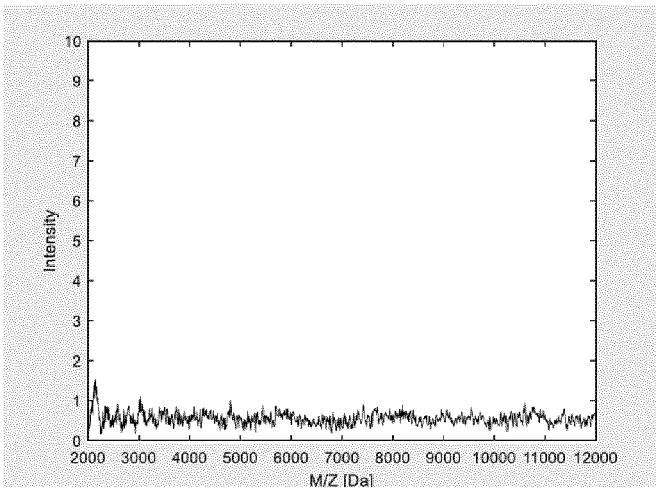

FIGS. 7*a* and 7*b* show the aerodynamic diameter and the mass spectrum of the fraction of non-spherical particles shown in FIG. 4;

FIGS. 8*a* and 8*b* show the aerodynamic diameter and the mass spectrum of the fraction of spherical particles shown in FIG. 4;

FIG. 9 shows a SEM image of a plurality of test samples prepared in accordance with a further embodiment of the invention, wherein the test composition further comprises a crystallisation promoting additive;

FIGS. 10*a* and 10*b* show the aerodynamic diameter and the mass spectrum of the test samples shown in FIG. 9;

FIG. 11 shows an SEM-image of a test sample prepared in accordance with the prior art;

FIG. 12 shows a MALDI mass spectrum of a test sample in accordance with the prior art;

DETAILED DESCRIPTION OF ILLUSTRATED EMBODIMENTS

The figures are not drawn to scale. Equal reference numerals in different figures refer to equal or corresponding features.

Figure 1:
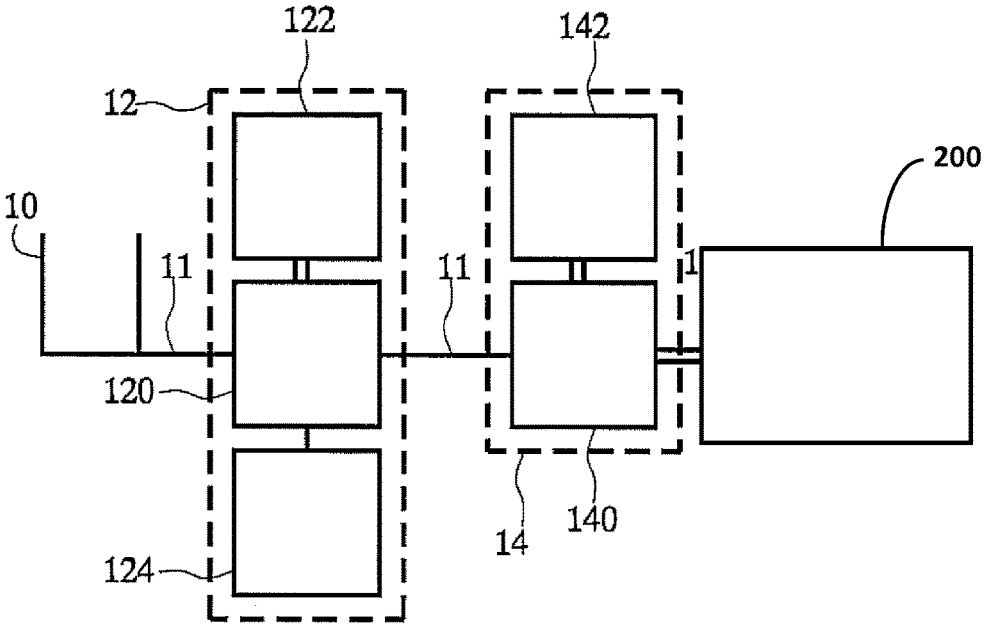
FIG. 1 shows a schematic representation of an apparatus for MALDI mass spectrometry with a preferred pre-treatment for a liquid test composition.
Figure 2:
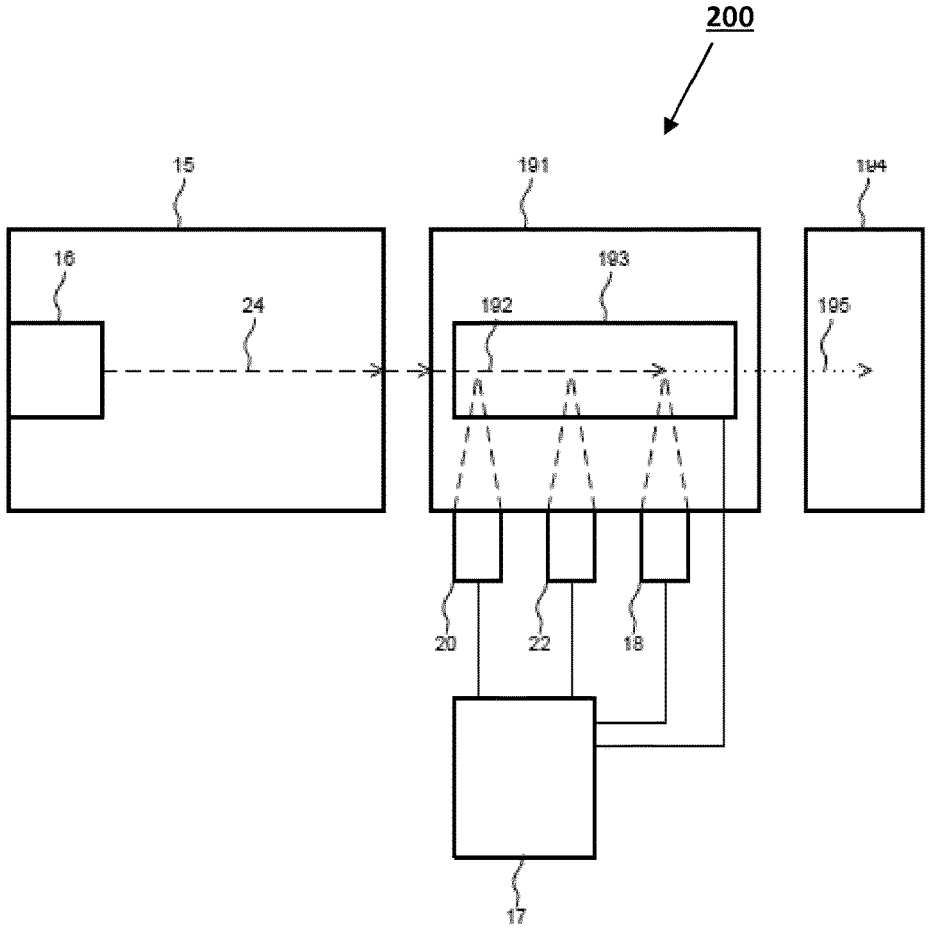
FIG. 2 shows a schematic representation of the particle flow path and mass spectrometer within the apparatus of FIG. 1.

FIG. 1 shows a schematic representation of a first embodiment of an apparatus for MALDI mass spectrometry. FIG. 2 shows in more detail the portion 200 of the apparatus, hereinafter also referred to as a flight path unit 200. MALDI mass spectrometry is particularly suitable for identification of biological material. One preferred type of biological material is micro-organisms such as bacteria, fungi and viruses. Other types of biological material that can be identified with MALDI include for instance blood cells, peptides. One specific form of MALDI is single particle MALDI, wherein a single test sample such as a droplet contains one or a limited number of individual biological organisms. The limited number is for instance at most 10, preferably at most 5, with further preference 1-3. It is however most preferred that the single particle MALDI is carried out such that there is one microorganism per test sample.

The apparatus comprises a sample receiver 10, conduits 11, a first mixing unit 12, a second mixing unit 14, and a flight path unit 200. The flight path unit comprises a drying chamber 15, a ionization chamber 191 and a time-of-flight tube 194. A droplet is ejected by any droplet ejector 16, such as for instance based on a piezoelectric resonator. The droplet follows a droplet beam 24 that extends from the drying chamber 15 into the time-of-flight tube 194. Upon drying the droplet beam 24 is actually converted into a particle beam 192. Upon ionization by radiation from a pulse laser 18, the particle beam 192 is converted into a ion beam 195. The mass spectrometer—not shown—measures the ions of the ion beam 195 and creates spectra on the basis thereof. According to one embodiment of the invention, use is made of a sensor 20, 22 for determining a morphology parameter so as to select particles that are ionized by a laser pulse of the pulse laser 18.

The first mixing unit 12 comprises a first mixer 120, a container 122 for solvent and/or antisolvent, such as water, and a detector 124. Rather than one container 122, two separate containers may be present. Sample material that is for instance obtained from a patient, is diluted with the solvent and/or antisolvent in the first mixer 120. Detector 124 is suitably an optical detector configured to detect light scattered from individual micro-organisms when the micro-organisms flow through a measurement beam. From a count of micro-organisms that are detected on average per unit of time interval, the density may be determined. Such detector 124 is known per se and is for instance a cytometer or flow cytometer. Particle detector 124 is shown coupled to a control input of first mixer 120. The control mechanism is arranged to increase the amount of solvent and/or antisolvent, until the measured density has dropped to or below a predefined density. Preferably both are added in a predefined ratio. A liquid circulation circuit may be used to circulate the composition until the desired density has been achieved. The second mixing unit 14 comprises a second mixer 14 and a matrix material reservoir 142. Matrix material reservoir 142 is coupled to the second mixer 140. The second mixer 14 is configured to mix the matrix material into the test composition obtained from the first mixing unit 12.

The droplet generator 16 may be provided with means for evaluation whether a droplet contains a single microorganism or any other number of microorganisms. Such a detecting means may be arranged to view the suspension in a channel prior to ejection by a nozzle. The generator 16 may further be provided with means for directing an ejected droplet to a first position or to a second position depending on information obtained from the detecting means. The first position is then a target position, i.e. a flow path towards the position where a laser source may eject radiation on the particle so as to ionize it. The second position is a waste position. The directing means are configured for deflection of the droplet or a motorized stage configured for directing the nozzle. Such an apparatus is known per se from EP2577254B1, and is included herein by reference.

In operation, a stream of liquid, containing analyte from sample receiver 10, a solvent and antisolvent from first mixing unit 12 and matrix material from the second mixing unit 14, is separated into sections that each result in a small liquid drop launched in flight through chamber 15. During flight through the drying chamber 15, the matrix material in a liquid drop crystallizes on the analyte, typically a microorganism, while the drop dries in flight, resulting in a dried particle, which is also referred to as the test sample. Typically, the drop is launched with a diameter in the range of 30-60 μm. The dried particle has an aerodynamic diameter of less than 3.0 μm in a first embodiment, wherein the test sample contains a single bacteria. If the dried particle crystallizes in accordance with the invention, rather than in amorphous form as in the prior art, the aerodynamic diameter of the dried particle in the first embodiment is even smaller, typically in the order of 1-2 μm. Because of the small size of the droplets, only little time during flight is needed to prepare the drops for ionization. Subsequently, a laser pulse is fired at the dried particle from pulse laser 18. This results in ionization of material from the test sample. The ionized material is detected in mass spectrometer. The processor that is coupled thereto processes the obtained data to generate a spectrum or data set that can be compared with known data sets. Such known data sets are typically stored in a library.

Sensing of droplets is achieved by means of determining a morphology parameter. In the present example, as discussed hereinafter, the sensor senses the aerodynamic diameter of a particle, and/or the standard deviation thereof. This is achieved by means of a first and a second detection channel 20, 22, each comprising a light source and a detector. The light source of the first detection channel 20 may be of any type, such as a source of visible light and a source of ultraviolet radiation. The light source of the second detection channel 22 is most preferably a source of visible light, such as for instance a light emitting diode of any suitable wavelength. The light detector is a photomultiplier in one embodiment.

While the first detection channel 20 could make use of a laser device with a wavelength in the UV-range, such as 266 nm, this requires the use of a fluorescence detector. However, fluorescence has a lower sensitivity requires a more sensitive detector. Moreover, the fluorescence detector needs at least two detection channels, one for the fluorescence and one for the scattering of visible light, including filters. Moreover two lasers are required, of which the UV-laser requires a high power. All in all, this constitutes a costly and complex detector that can be avoided when using visible light. With two detection channels of visible light, a single laser and a beamsplitter is sufficient.

Figure 3:
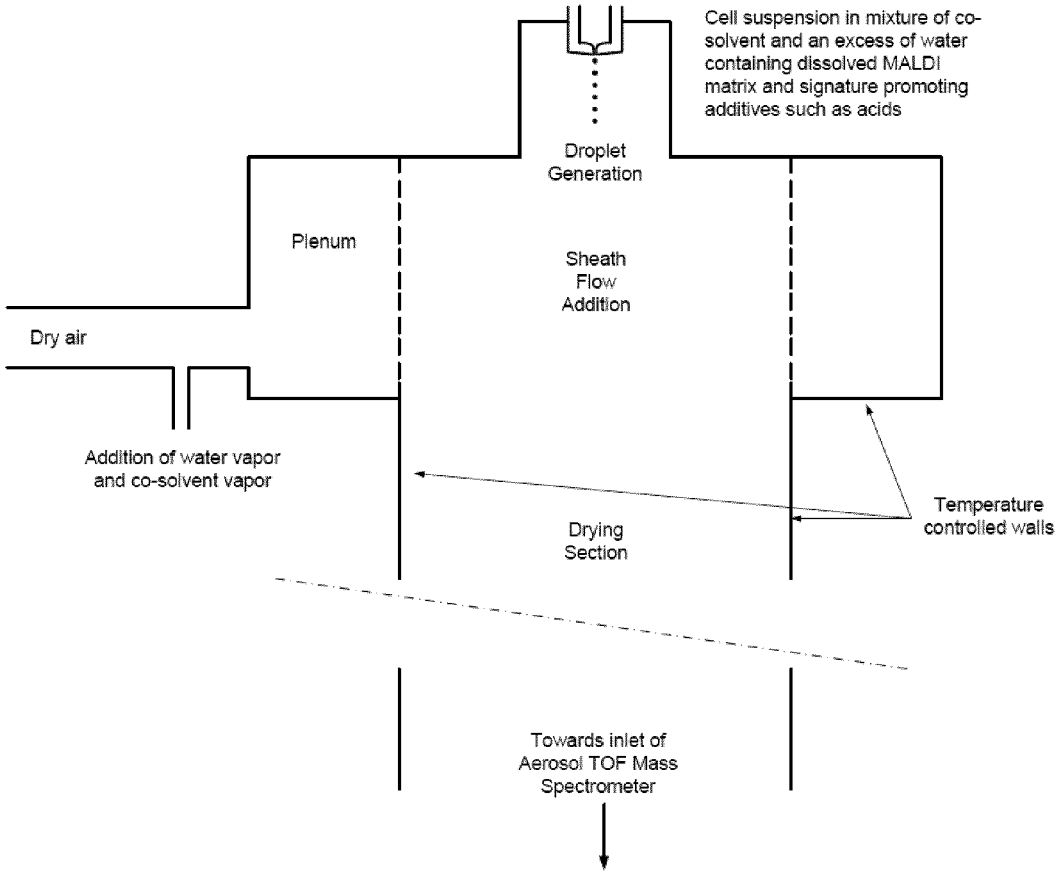
FIG. 3 shows a schematic overview of a droplet generator and a chamber including a flow path in which evaporation and crystallisation occurs.

FIG. 3 shows the outlet of droplet generator 16 and the chamber 15 in more detail. In this figure, the flow path of a droplet through the chamber 15 may have a vertical orientation. Due to the small droplet size, it has been found that the droplets quickly, i.e. in the first few centimetres of the flow path, arrive at a constant velocity. This velocity is a balance of gravity and aerodynamic resistance. The chamber 15 is provided with temperature controlled walls so as to keep the temperature in the chamber constant. In one embodiment a temperature of 22-30° C. is chosen. The chamber 15 is further provided with an inlet for gas generating a homogeneously distributed sheath flow. The gas comprises for instance air or nitrogen and is controlled with respect to the concentration of water vapour and optionally any solvent or co-solvent vapour. Suitably, the water vapour concentration is controller such that the relative humidity is 30% or more. The sheath flow transports the droplets towards the inlet of the aerosol time-of-flight mass spectrometer.

Thus, in summary, the MALDI mass spectrometry method of the invention comprises the provision of a test composition comprising an analyte, a matrix material, a solvent for the matrix material and an antisolvent, which facilitates crystallization of the matrix material on the analyte subsequent to droplet generation. Due to the crystallization, a non-spherical particle morphology of the test sample is obtained. The test sample with a non-spherical particle morphology can be distinguished from test samples with an at least substantially spherical particle morphology by sensing a morphology parameter. Based on the sensing result, test samples with a non-spherical particle morphology are selected for ionization and mass spectrometry. The antisolvent is for instance water, and the solvent is an organic solvent. The formed crystals are in one embodiment crystallized in a hydrate form.

EXAMPLES

Example 1 (Comparative)

A test composition was prepared from a suspension of *Staphylococcus Epidermidis* cells and α-cyano-4-hydroxycinnamic acid (αCHCA) as a matrix material dissolved in a 1:1 water-acetonitrile mixture. αCHCA has a solubility of 6 mg/ml in water. As a consequence, water is not an antisolvent for αCHCA. Droplets thereof were generated by means of the droplet generator. The droplets were dried during flight as described with reference to FIG. 1-3. Almost monodisperse particles were formed that constitute the test samples, as shown in FIG. 11. This is a SEM image prepared on a Philips electron microscope at a pressure of 100 kPa, a voltage of 4.00 kV. These particles contain a centrally located cell, coated with an amorphous layer of dry matrix. After ionization, mass spectrometry was carried out. The resulting spectrum is shown in FIG. 12. It is apparent that no signature could be obtained.

Example 2 (Invention)

*Escherichia coli* cells in a 10/90 (vol/vol) acetonitrile/water mixture containing approximately 300 ppm (w/w) 2-mercapto-4,5-dimethylthiazole at a temperature of approximately 25° C. and a relative humidity of approximately 30%. Plate-like crystalline particles and spherical amorphous particles were obtained. FIG. 4 is a SEM image of the particles in which both type of particles are clearly recognizable. In addition to plate-like crystalline particles needle-shaped crystals could be observed. In order to identify the various particles visible in FIG. 4, the aerodynamic diameter and the mass spectrum were determined. The results are shown in FIGS. 6, 7 and 8 (*a*) and (*b*). FIGS. 6(*a*), 7(*a*) and 8(*a*) show the aerodynamic diameter. FIGS. 6(*b*), 7(*b*) and 8(*b*) show the corresponding mass spectra.

In FIGS. 6(*a*) and 6(*b*), the results of all particles are shown. It is apparent that there is a significant variation of the aerodynamic diameter, with a strong peak. While the scale is not shown in FIG. 5(*a*), the peak location of the strongest peak corresponds to 2.8 μm.

FIGS. 7(*a*) and 7(*b*) show the results of the non-spherical particles. A significant variation in aerodynamic diameter is shown, and a signature-rich mass spectrum is obtained.

FIGS. 8(*a*) and 8(*b*) show the results of the spherical particles. The sensing of the aerodynamic diameter results in a peak with a quite limited width. The mass spectrum is however very signature-poor, and does not at all allow any kind of identification.

The experiments of this example were repeated with a variety of bacteria and other microorganisms. Good results were obtained regardless of the cellular analyte. Furthermore, the excess of water was varied in a series of experiments, demonstrating good results also with another volume ratio than 10/90 between the organic solvent and water, for instance 30/70.

Example 3

Figure 5:
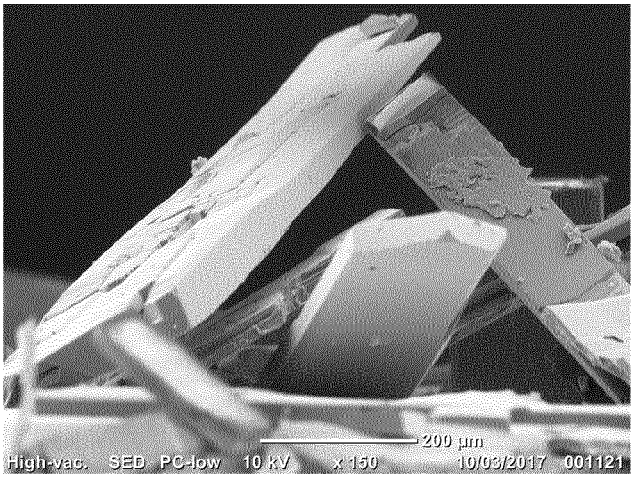
FIG. 5 shows a SEM image of a crystallized matrix material without analyte.

Crystallization of the matrix material 2-mercapto-4,5-dimethylthiazole was carried out separately. The crystals are obtained by washing the matrix material, as obtained after synthesis, in a mixture of water and ethanol, and subsequent drying in a vacuum oven. The result is shown in FIG. 5

Example 4

A further test composition was prepared further comprising graphene flakes as commercially available. The test composition was subjected to the method of the invention. A SEM-image was prepared of the test samples, which is shown in FIG. 9. It is apparent that the number of spherical particles has decreased drastically relatively to the use of the test composition used in Example 2. FIG. 10(*a*) shows the distribution of the aerodynamic diameter, indicating a relatively broad distribution. FIG. 10(*b*) shows a mass spectrum that essentially corresponds to the mass spectrum of FIG. 7(*b*).

The invention claimed is:

1. A MALDI mass spectrometry method for analysing a cellular analyte comprising:

Providing a test composition comprising the cellular analyte, a matrix material and a solvent for the matrix material, wherein said test composition is a suspension of the analyte;

Generating a beam of droplets from the test composition, said droplets being ejected into a flow path with a length sufficient to achieve evaporation of the solvent and precipitation of the matrix material on the cellular analyte, therewith obtaining test samples;

Ionizing at least some of the test samples in said flow path to obtain ionized components;

Detecting the ionized components by means of a time-of-flight mass spectrometer; and Identifying the cellular analyte on the basis of the detected ionized components, wherein:

the test composition further comprises an aqueous antisolvent, wherein the solvent has a higher volatility than the antisolvent and wherein the antisolvent is present in excess quantity relative to the solvent, and the droplets have a diameter in the range of 20-70 pm, preferably, 30-60 pm, wherein the provision of the test composition as droplets with the specified droplet diameter facilitates crystallisation of the matrix material onto the cellular analyte subsequent to droplet generation, which crystallisation effects a non-spherical particle morphology of the test sample.

2. The MALDI mass spectrometry method as claimed in claim 1, further comprising the step of providing a laminar gas flow in a tubular chamber defining the flow path of the ejected droplets, said gas flow being preferably air flow.

3. The MALDI mass spectrometry method as claimed in claim 1, wherein the matrix material has an intrinsic solubility in the antisolvent at room temperature of at most 2 mg/ml, preferably at most 1 mg/ml, more preferably at most 0.5 mg/ml.

4. The MALDI mass spectrometry method as claimed in claim 1, wherein the solvent and antisolvent are present in the test composition in a mass ratio in the range of 0.03 (1:33) to 0.33 (1:3).

5. The MALDI mass spectrometry method as claimed in claim 1, wherein the matrix material includes an aromatic ring, at least one functional group capable of hydrogen bonding and an C1-C8-alkyl chain.

6. The MALDI mass spectrometry method as claimed in claim 5, wherein the matrix material is chosen from the group of 2-mercapto-4,5-dialkylheteroarenes according to the formula (I)

(I)

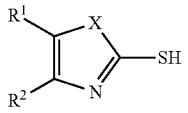

Wherein X is N, S or O, and wherein $R^1$ and R are independently chosen from hydrogen, methyl, ethyl, methoxy, ethoxy, propoxy, at least one of $R^1$ and $R^2$ being different from hydrogen.

7. The MALDI mass spectrometry method as claimed in claim 5, wherein the matrix material is chosen from the group of C1-C8-alkyl esters of the group of optionally cyano-substituted hydroxyl-substituted cinnamic acid.

8. The MALDI mass spectrometry method as claimed in claim 1, wherein test samples are selected prior to ionization on the basis of a sensed parameter, which sensed parameter is a morphology parameter representative of the particle morphology of the test sample.

9. The MALDI mass spectrometry method as claimed in claim 8, wherein the selection comprises evaluating whether the test particle has a non-spherical particle morphology or an at least substantially spherical particle morphology.

10. The MALDI mass spectrometry method as claimed in claim 8, wherein sensing the morphology parameter comprises measuring an aerodynamic diameter of the test sample and/or identifying a standard deviation of an aerodynamic diameter of the test sample.

11. The MALDI mass spectrometry method as claimed in claim 1, wherein the test composition further comprises a crystallisation promoting additive, wherein the crystallisation promoting additive preferably comprises hydrophobic particles, for instance graphene flakes, wherein more preferably the particles are present so as to provide a single particle per droplet.

12. The MALDI mass spectrometry method as claimed in claim 1, wherein the matrix material crystallizes in the form of a hydrate.

13. The MALDI mass spectrometry method as claimed in claim 1, wherein the analyte is a microbiological organism in the form of a single cell.

14. The MALDI mass spectrometry method as claimed in claim 1, further comprising the step of optically detecting whether a droplet contains the analyte.

15. The MALDI mass spectrometry method as claimed in claim 1, wherein the droplet generation comprises printing a droplet from a nozzle, and preferably wherein the flow path is a vertical flow path under impact of gravity.

16. A MALDI mass spectrometry apparatus, comprising:

A droplet generation device for generation a beam of droplets, provided with a container for a test composition comprising a cellular analyte;

A tubular chamber downstream of the droplet generation device and including a flow path of sufficient length to achieve evaporation of the solvent and precipitation of the matrix material on the cellular analyte, therewith obtaining a test sample;

Sensing means for measuring a parameter of test samples in the chamber;

A time-of-flight mass spectrometer;

Ionization means for selectively ionizing test samples to be detected by the mass spectrometer; and A processor for selection of test samples based on the sensed parameter and for identifying an analyte based on detected ionized components of the mass spectrometer, wherein the sensing means are configured for measuring a morphology parameter representative of a particle morphology of the test samples, and wherein said processor is configured for identifying a morphology of a test sample and to select the test samples for ionization based the identified morphology.

17. The MALDI mass spectrometry apparatus as claimed in claim 16, wherein the apparatus is provided with means for generating a laminar gas flow, preferably a laminar air flow, in the tubular chamber.

18. A method of using a test composition for carrying out a MALDI mass spectrometry analysis on a cellular analyte, said test composition comprising a solvent, a matrix material, and an aqueous anti-solvent and is configured to be mixed with the cellular analyte and thereafter to be ejected as a beam of droplets with a droplet diameter of 20-70 pm, preferably 30-60 pm, so as to achieve crystallization of the matrix material onto the cellular analyte in a flow path, the cellular analyte with the crystallized matrix material having a substantially non-spherical shape, wherein the matrix material includes an aromatic ring, at least one functional group capable of hydrogen bonding and an C1-C8-alkyl chain, preferably C1-C4 alkyl chain, the matrix material has a solubility in the antisolvent of at most 2 mg/ml, preferably at most 1 mg/ml, more preferably at most 0.5 mg/ml, and the solvent has a higher volatility than the antisolvent and the solvent and the aqueous antisolvent are present in a mass ratio in the range of 0.03 (1:33) to 0.33 (1:3), preferably 0.05 (1:20) to 0.25 (1:4).

19. The method as claimed in claim 18, further comprising a crystallisation promoting additive, wherein the crystallisation promoting additive preferably comprises hydrophobic particles, for instance graphene flakes.

20. The method as claimed in claim 18, wherein said matrix material crystallizes, at least largely, in a hydrate form.

* * * * *